US006564530B2

(12) United States Patent
Marco

(10) Patent No.: US 6,564,530 B2
(45) Date of Patent: May 20, 2003

(54) FILM MULTIPACKAGE

(75) Inventor: Leslie S. Marco, Bloomingdale, IL (US)

(73) Assignee: Illinois Tool Works Inc., Glenview, IL (US)

( * ) Notice: Subject to any disclaimer, the term of this patent is extended or adjusted under 35 U.S.C. 154(b) by 0 days.

(21) Appl. No.: 09/777,628

(22) Filed: Feb. 6, 2001

(65) Prior Publication Data

US 2001/0025800 A1 Oct. 4, 2001

Related U.S. Application Data

(63) Continuation-in-part of application No. 09/220,428, filed on Dec. 24, 1998, now Pat. No. 6,213,293.

(51) Int. Cl.[7] ..... B65B 21/00; B65B 21/24

(52) U.S. Cl. ..... 53/398; 53/48.3; 53/48.4; 53/48.5

(58) Field of Search ..... 53/398, 48.3, 48.4, 53/48.5

(56) References Cited

U.S. PATENT DOCUMENTS

| | | | | |
|---|---|---|---|---|
| 2,359,297 A | * | 10/1944 | Brogden | 53/48.4 |
| 2,654,474 A | | 10/1953 | Ringler | |
| 2,701,661 A | | 2/1955 | Murray | |
| 2,946,621 A | | 7/1960 | Williamson | |
| 3,084,792 A | | 4/1963 | Poupitch | |
| 3,118,537 A | | 1/1964 | Copping | |
| 3,186,544 A | * | 6/1965 | Curry | 206/162 |
| 3,198,327 A | | 8/1965 | Boehling et al. | |
| 3,200,944 A | | 8/1965 | Rapata | |
| 3,214,016 A | | 10/1965 | Stephan | |
| 3,217,874 A | | 11/1965 | Potter | |
| 3,325,004 A | | 6/1967 | Wanderer | |
| 3,410,596 A | | 11/1968 | Slevin, Jr. | |
| 3,460,863 A | | 8/1969 | Schaich | |
| 3,509,684 A | * | 5/1970 | Hohl | 53/48.4 |
| 3,570,746 A | | 3/1971 | Wood | |
| 3,700,275 A | * | 10/1972 | Deasy | 53/398 |
| 3,899,076 A | | 8/1975 | Florian | |
| 4,121,401 A | * | 10/1978 | Duerr et al. | 53/398 |
| 4,378,879 A | | 4/1983 | Killy | |
| 4,403,689 A | | 9/1983 | Wood | |
| 4,471,870 A | | 9/1984 | Uhlig | |
| 4,523,676 A | | 6/1985 | Barrash | |
| 4,560,064 A | | 12/1985 | Peterson et al. | |
| 4,637,515 A | | 1/1987 | Wilson et al. | |
| 4,779,731 A | | 10/1988 | Fujio | |
| 4,807,751 A | | 2/1989 | Klygis et al. | |
| 4,828,110 A | | 5/1989 | Lems | |
| 4,893,712 A | | 1/1990 | Allen et al. | |
| 4,932,528 A | | 6/1990 | Benno | |
| 5,305,877 A | | 4/1994 | Olsen | |
| 5,311,984 A | | 5/1994 | Harris | |
| 5,328,024 A | | 7/1994 | Sutherland | |
| 5,360,104 A | | 11/1994 | Sutherland | |
| 5,390,784 A | | 2/1995 | Sutherland | |
| 5,425,446 A | | 6/1995 | Weaver et al. | |
| 5,487,463 A | | 1/1996 | Harris | |

(List continued on next page.)

FOREIGN PATENT DOCUMENTS

| | | |
|---|---|---|
| EP | 1 013 564 | 6/2000 |
| FR | 2 015 754 | 4/1970 |
| FR | 2 169 442 | 9/1973 |
| WO | 93/14992 | 8/1993 |

*Primary Examiner*—John Sipos
(74) *Attorney, Agent, or Firm*—Pauley Petersen Kinne & Erickson

(57) ABSTRACT

This invention relates to a single-piece carrier for unitizing a plurality of containers with a retainer sheet integrated with a film sleeve. The retainer sheet may comprise a thicker material than the film sleeve. The retainer sheet comprises a plurality of container receiving openings for engaging a top portion of each container while the film sleeve surrounds the plurality of containers. Packages may comprise one or more layers of containers within the film sleeve.

10 Claims, 10 Drawing Sheets

U.S. PATENT DOCUMENTS 5,538,133 A 7/1996 Campbell et al.
5,582,289 A 12/1996 Wright
5,590,776 A 1/1997 Galbierz et al.
5,653,334 A 8/1997 Marco
5,701,994 A * 12/1997 Marsh ..... 53/398
6,145,656 A 11/2000 Marco

* cited by examiner

FILM MULTIPACKAGE

CROSS REFERENCE TO RELATED APPLICATION

This application is a continuation-in-part application of U.S. patent application Ser. No. 09/220,428, filed Dec. 24, 1998, now U.S. Pat. No. 6,213,293.

BACKGROUND OF THE INVENTION

1. Field of the Invention

This invention relates to a device and method of manufacture of the device for unitizing a plurality of containers, the carrier having a retainer sheet for engaging a top portion of the containers integrated with a film sleeve for surrounding the containers.

2. Description of Prior Art

Conventional container carriers are often used to unitize a plurality of similarly sized containers, such as cans, bottles, jars and boxes, although other packages or containers may be unitized. Plastic ring carriers and box carriers are two such conventional container carriers.

The plastic ring carrier produces a unitized package for containers using little material. However, the plastic ring carrier, when used alone in most instances, has little or no advertising or promotional printing space. Conversely, the box carrier generally has a relatively large amount of area for promotional graphics. Disadvantageously, the box carrier requires a relatively large amount of material, may permit containers to fall out if it is not maintained in an upright position, and usually shrouds most or all of the actual containers. Therefore, there is a need for a package that incorporates the stability and economy of a ring carrier and the promotional area of a box carrier.

SUMMARY OF THE INVENTION

It is one object of this invention to provide a container carrier that unitizes a plurality of containers into a tight, solid package.

It is another object of this invention to provide a container carrier that provides a prominent billboard space for merchandising information.

It is still another object of this invention to provide a container carrier which restricts lateral and vertical movement of the containers with respect to one another.

It is yet another object of this invention to provide a container carrier that incorporates the stability and economy of a ring carrier and the promotional area of a box carrier.

It is still another object of this invention to provide a container carrier that utilizes a film sleeve to maintain a tight configuration of unitized containers.

A carrier according to this invention carries a plurality of containers such as cans or bottles. The carrier unitizes a plurality of containers to create a package. The carrier is a single-piece device comprising a retainer sheet integrated with a film sleeve, each preferably constructed from a flexible, resilient material such as plastic. The retainer sheet preferably has a first thickness different from and thicker than a second thickness of the film sleeve.

The retainer sheet is formed with a plurality of container receiving openings the number of which depends upon the intended size of the package. The retainer sheet is integrated with the film sleeve preferably along longitudinal sides of the retainer sheet.

The film sleeve may be designed to create a package open at a bottom of the package or along a lower edge of the carrier. The film sleeve may further include a bottom along a portion of the lower edge of the film sleeve. Each side edge of the film sleeve is preferably bound with a seal. The carrier when formed is preferably generally symmetrical around fold lines of the carrier.

Containers are inserted within the carrier so that the containers are surrounded by between five and six sides of the package. Each container receiving opening in the retainer sheet preferably engages a container around an upper portion of the container. The rigidity and elasticity of the retainer sheet thereby supports each container.

The film sleeve is positioned around the plurality of containers, preferably in a stretching engagement with the containers. The film sleeve is preferably printed with graphics, promotional and/or other information related to contents and/or ingredients of package. Therefore, the film sleeve serves both to unitize the plurality of containers and to advertise the nature of the contents of the containers.

The carrier is preferably manufactured according to one of several preferred methods wherein a generally continuous length of carriers is formed. In summary, a film substrate and/or film sleeve material is printed with desired graphics and other merchandising information. A retainer sheet material is next joined to the film substrate and/or film sleeve material by heat sealing, extrusion coating, laminating, profile extrusion or glueing the retainer sheet material to the film substrate and/or film sleeve material. The joined retainer sheet material and film substrate and/or film sleeve material are next either folded along a fold line to create a symmetrical double layer or laminated to an identical section of joined retainer sheet material and film substrate and/or film sleeve material thereby creating a carrier blank. Seams are next added by heat sealing or laminating the symmetrical double layer of retainer sheet material and film substrate and/or film sleeve material together. Finally, the carrier is formed by die cutting the double layer of retainer sheet material and film substrate to create container receiving openings and to define a film sleeve and a retainer sheet.

BRIEF DESCRIPTION OF THE DRAWINGS

The above-mentioned and other features and objects of this invention will be better understood from the following detailed description taken in conjunction with the drawings wherein.

DESCRIPTION OF PREFERRED EMBODIMENTS

Figure 1:
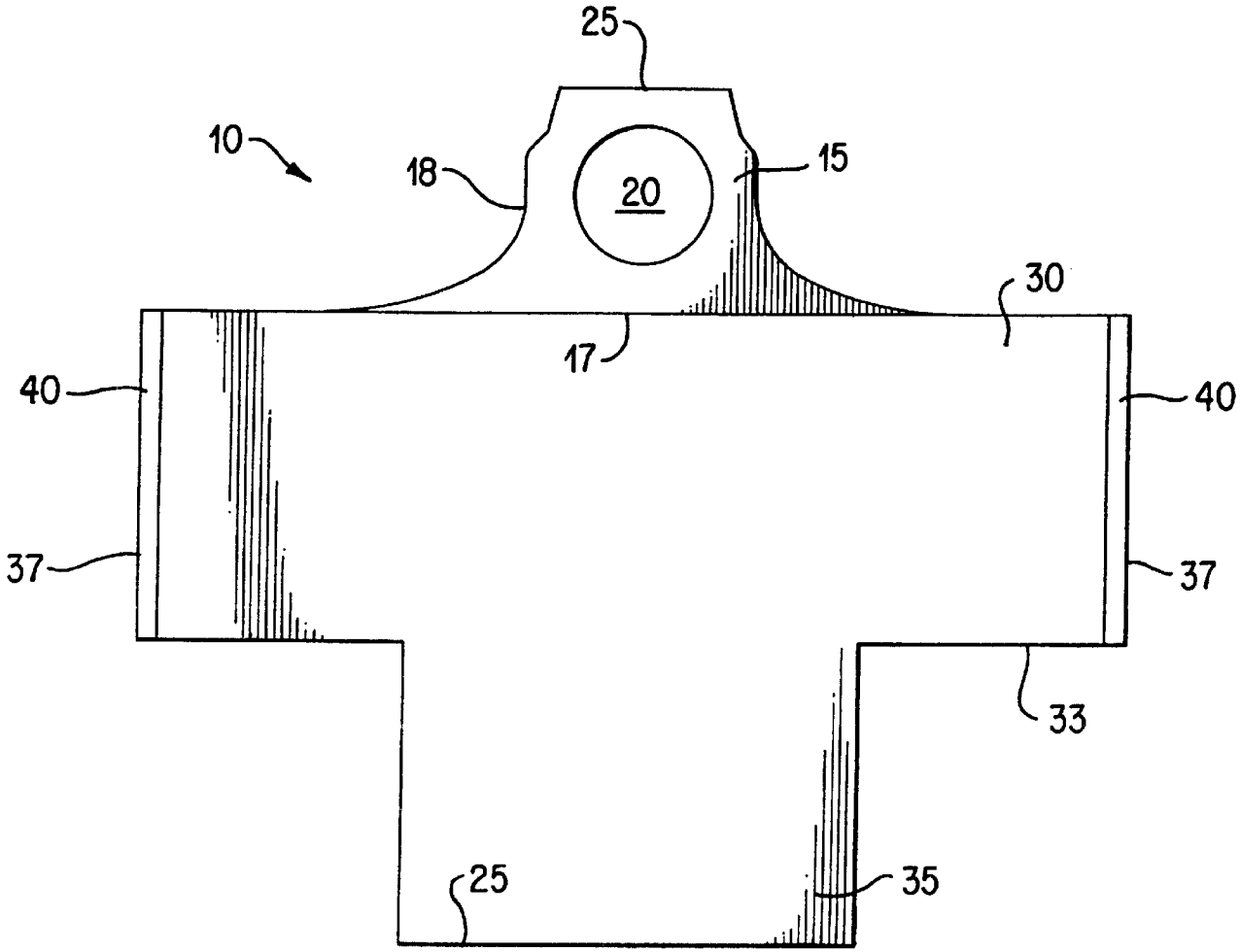
FIG. 1 is a top view of a carrier for holding a plurality of containers according to one preferred embodiment of this invention.
Figure 2:
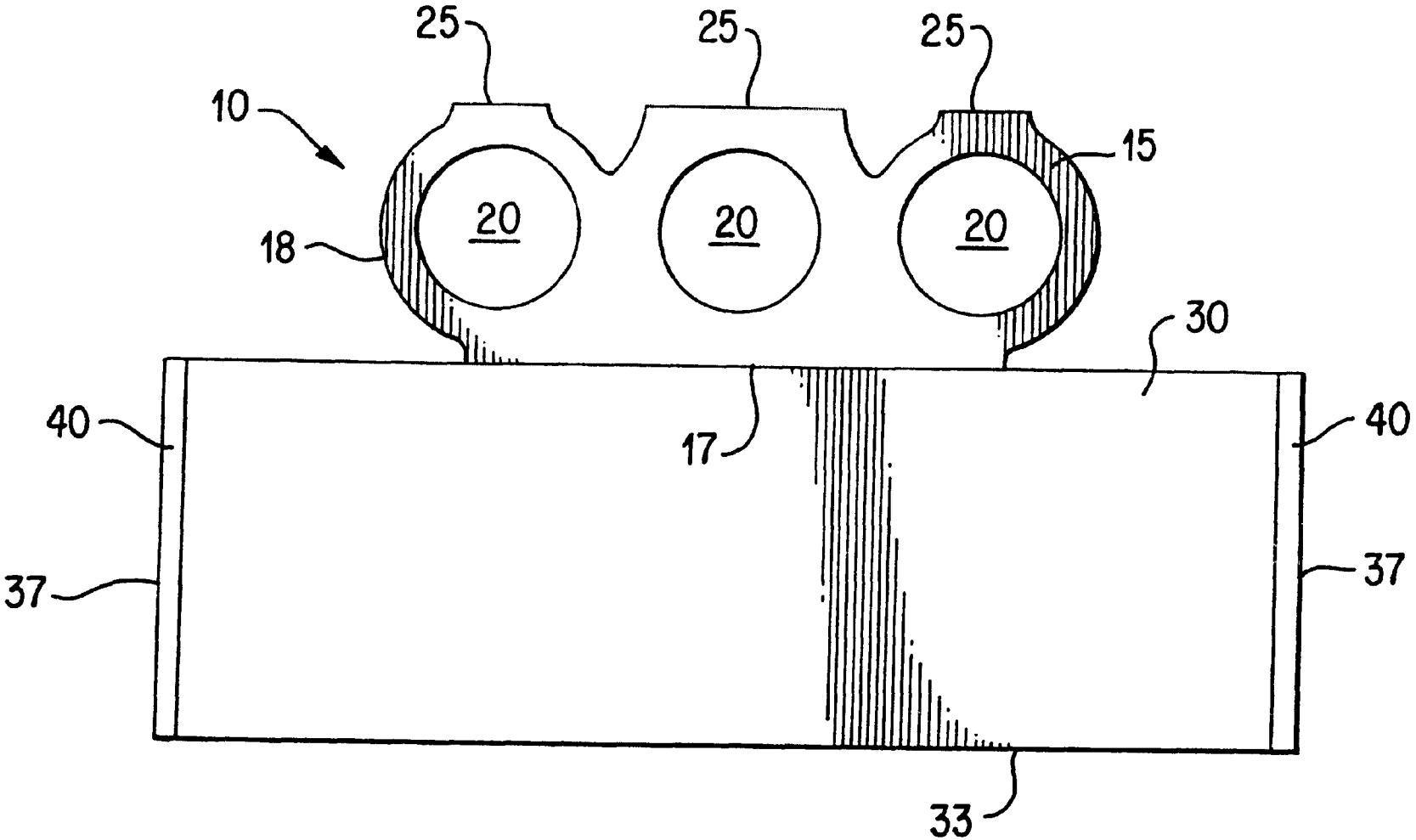
FIG. 2 is a top view of a carrier for holding a plurality of containers according to another preferred embodiment of this invention.
Figure 3:
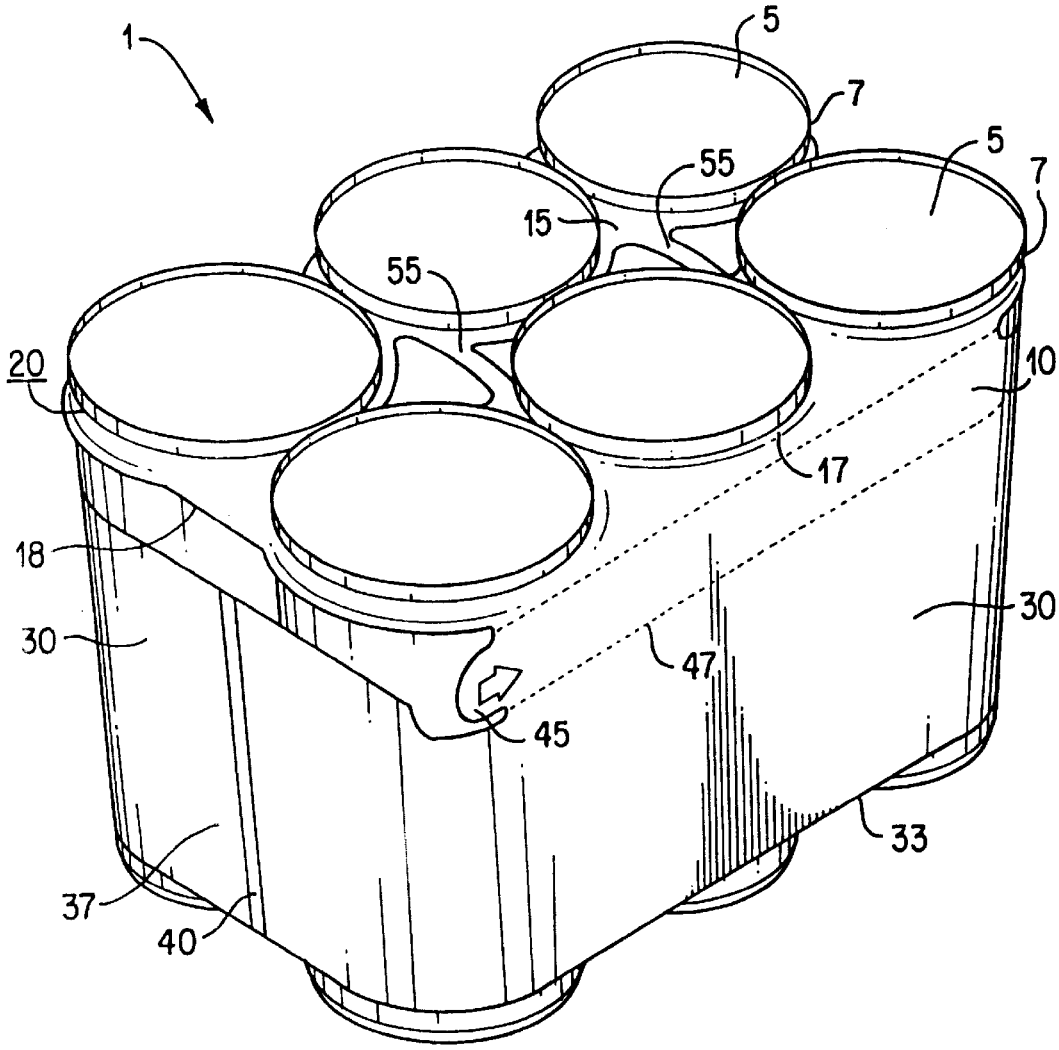
FIG. 3 is a perspective view of a package of containers, using a carrier similar to the carrier shown in FIG. 2, according to one preferred embodiment of this invention.
Figure 4:
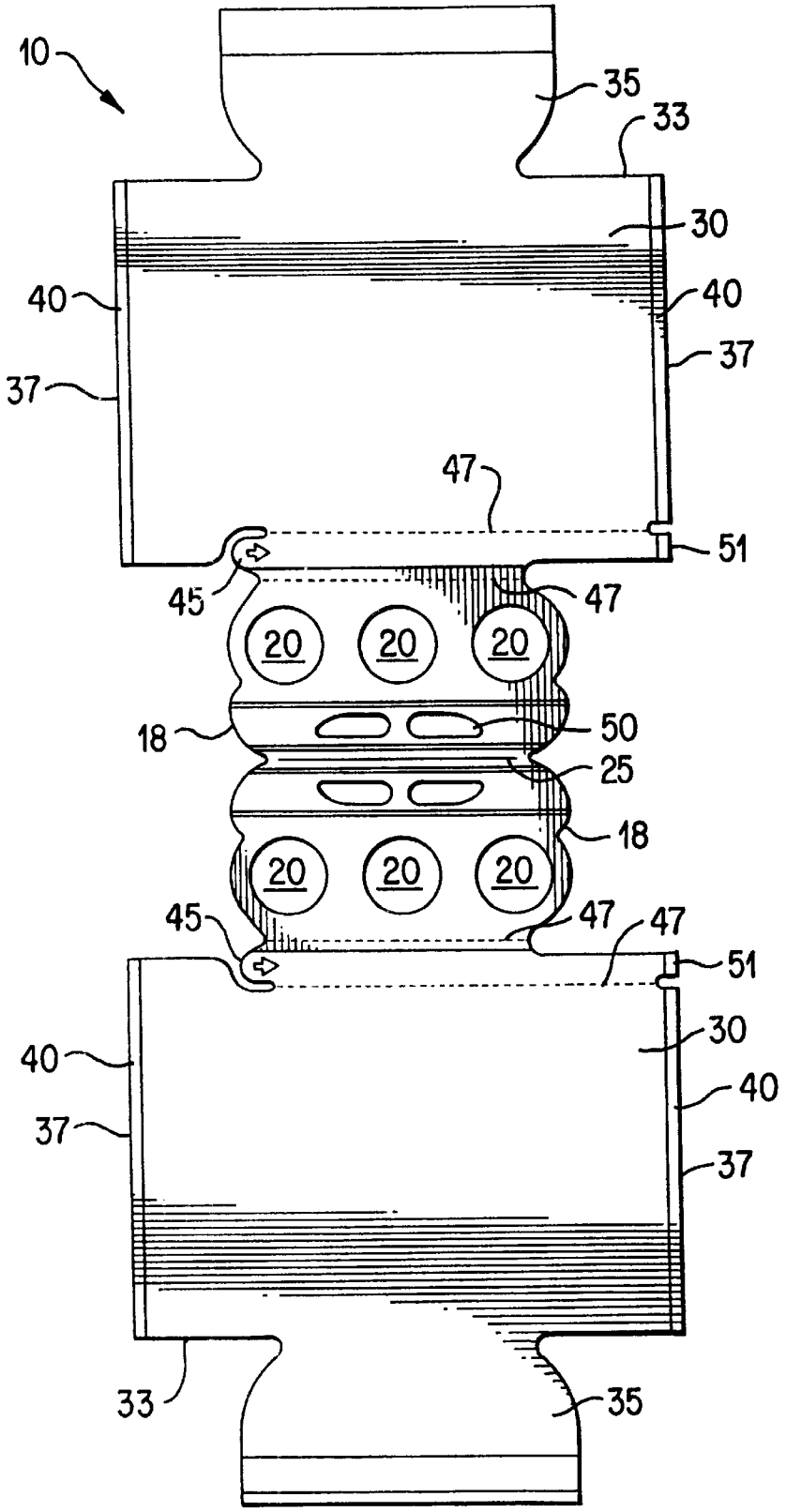
FIG. 4 is a top view of a carrier for holding a plurality of containers according to another preferred embodiment of this invention.

FIGS. 1–10 show carriers 10 for carrying a plurality of containers 5. Containers 5 as shown in FIGS. 3 and 4 are preferably cans. Although cans are shown in FIGS. 3 and 4, bottles or any other commonly unitized container 5 may be used with carrier 10 according to this invention. Containers 5 are preferably like-sized within a single carrier 10.

Figure 5:
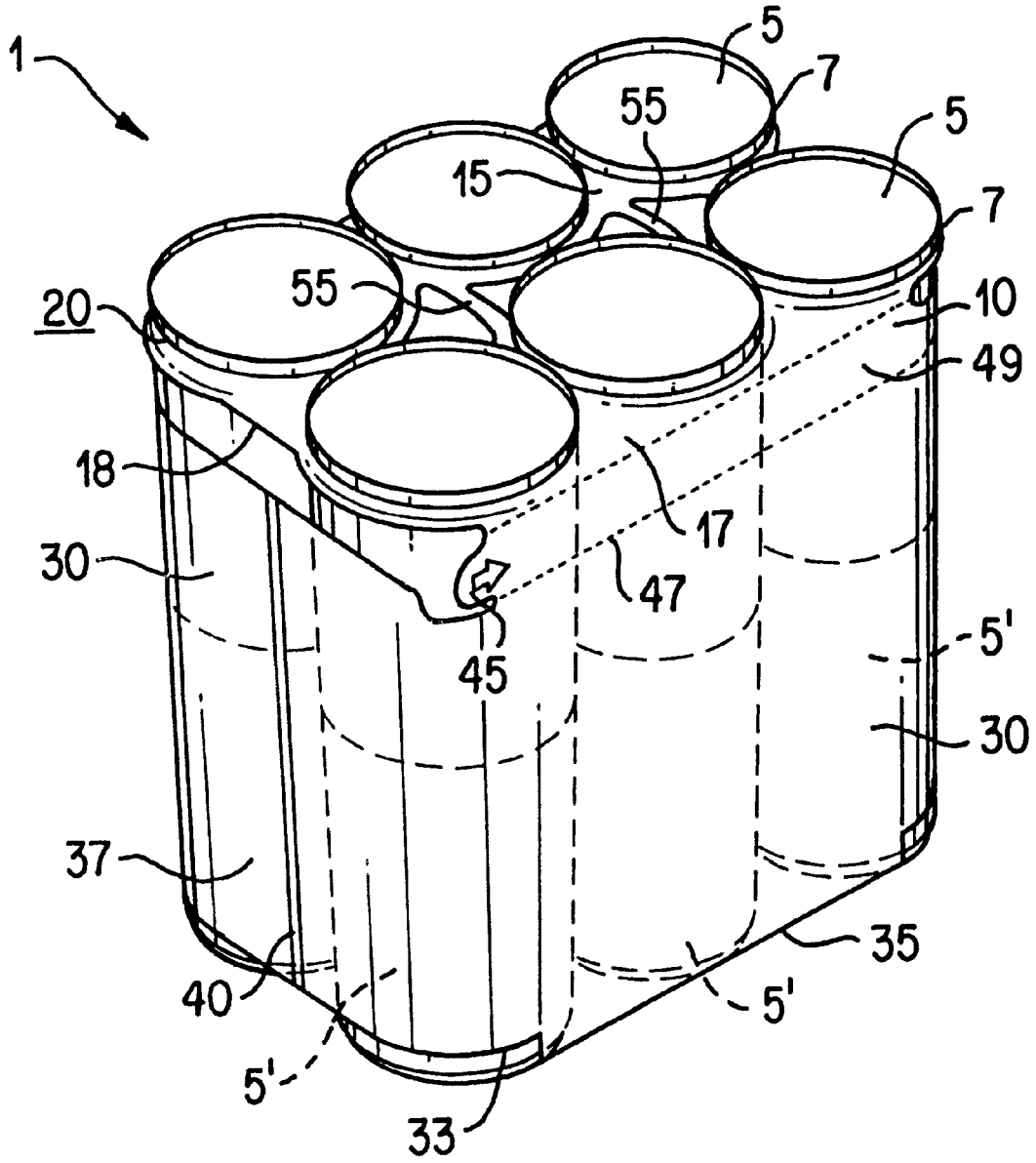
FIG. 5 is a perspective view of a package of containers, using a carrier similar to the carrier shown in FIG. 4, according to one preferred embodiment of this invention.

Carrier 10 unitizes a plurality of containers 5 to create package 1, such as package 1 shown in FIGS. 3 and 5. Carrier 10 is preferably a single-piece device comprising retainer sheet 15 integrated with film sleeve 30, each preferably constructed from a flexible, resilient material such as plastic. For the purposes of this specification and claims, a sleeve is defined as a tubelike component capable of fitting over or around a plurality of containers 5.

In one preferred embodiment of this invention, retainer sheet 15 is made from low density polyethylene. In other embodiments, a higher density polyethylene is preferable having a different thickness. Retainer sheet 15 preferably has a first thickness, such as between 0.008–0.020", possibly thinner than the thickness of traditional plastic ring carriers. As discussed in additional detail below, retainer sheet 15 is preferably cut, using means known to those skilled in the art such as a stamping die, to form a plurality of container receiving openings 20 in retainer sheet 15. Two or more container receiving openings 20 are formed in retainer sheet 15 in longitudinal rows and one or more transverse ranks. In one preferred embodiment of this invention shown in FIGS. 2–5, container receiving openings 20 are configured in two rows of three ranks. Retainer sheet 15 may include other configurations of container receiving openings 20 depending on the size of package 1 desired.

Retainer sheet 15 is integrated with film sleeve 30 to form a single-piece carrier 10, as described in detail below. According to one preferred embodiment of this invention, film sleeve 30 has a second thickness that is thinner than the first thickness of retainer sheet 15, such as 0.004" to 0.006". The total thickness of retainer sheet 15 may range between approximately 0.008–0.026" according to one preferred embodiment of this invention. Film sleeve 30 may exhibit different elasticity and different rigidity than retainer sheet 15. Film sleeve 30 may comprise a stretchable low density polyethylene (LDPE) film or similar material known to those having ordinary skill in the art.

In one preferred embodiment of this invention, shown in FIGS. 6, 8, 9 and 10, handle 50 is integrated within retainer sheet 15. Handle 50 preferably has a same or similar thickness as retainer sheet 15. In one preferred embodiment of this invention, shown in FIGS. 6 and 8, handle 50 is integrated between longitudinal rows of container receiving openings 20. Alternatively, package 1 may be carried using bands 55 formed between container receiving openings 20 as shown in FIGS. 3 and 5.

Film sleeve 30 is preferably integrated with retainer sheet 15 along longitudinal sides 17 of retainer sheet 15. In one preferred embodiment of this invention, film sleeve 30 is not connected along two lateral edges 18 of retainer sheet 15. Film sleeve 30 is preferably printed with, on one or both sides, UPC and proof of purchase labels, graphics, and promotional and/or other information related to contents and/or ingredients of package 1. Film sleeve 30 may additionally be at least partially transparent to effectively display the nature of containers 5. Therefore, film sleeve 30 serves the dual purposes of retaining containers 5 within a tightly assembled package 1 and advertising marketable features of the containers 5 and/or package 1.

In one preferred embodiment of this invention shown in FIG. 2, film sleeve 30 is open along lower edge 33 of carrier 10. As shown in FIG. 1, lower edge 33 of carrier 10 may further include bottom 35 of film sleeve 30. Each side edge 37 of film sleeve 30 is preferably bound with seal 40. Therefore, film sleeve 30 extends from openable lower edge 33 of carrier to seals 40 on either side edge 37 of film sleeve to retainer sheet 15 at a top portion of carrier 10.

As shown in FIGS. 1 and 2, carrier 10 is preferably generally symmetrical around fold lines 25. As discussed in detail below, carrier 10 is manufactured so that retainer sheet 15 and film sleeve 30 are each preferably symmetrical around fold lines 25.

Carrier 10 is applied to a plurality of containers 5 to form package 1, shown in FIGS. 3 and 5. Containers 5 are inserted within carrier 10 which bounds containers 5 around between five and six sides of package 1. Each container receiving opening 20 preferably engages container 5, preferably around chime 7 or similar upper portion of container 5. The rigidity and elasticity of retainer sheet 15 supports container 5 within container receiving opening 20. A top portion of package 1 is therefore at least partially covered by retainer sheet 15.

As shown in FIGS. 3 and 5, film sleeve 30 is positioned around the plurality of containers 5. Preferably, film sleeve 30 is stretchingly engaged with containers 5 and the combination of container receiving openings 20 and sleeve 30 prevents skewing or lateral movement of containers 5 with respect to each other. In one preferred embodiment of this invention, shown in FIGS. 2 and 3, film sleeve 30 covers at least a portion of four horizontal sides of package 1.

Containers 5 are positioned within package 1 so that film sleeve 30 is flat and tight with respect to containers 5 and prominent with respect to package 1. Film sleeve 30 is preferably sized to stretch when slid over a plurality of containers 5. Such a configuration of film sleeve 30 results in package 1 having a prominent display area or "billboard" for advertising, information, graphics and other marketing material.

In another preferred embodiment of this invention, shown in FIGS. 1, 4 and 5, film sleeve 30 covers at least a portion of a bottom of package 1. Film sleeve 30 preferably covers at least a portion of the bottom of package 1 when one or more containers 5 are not engaged with container receiving openings 20. For instance, carrier 10 shown in FIG. 1 requires bottom 35 because retainer sheet 15 includes only two container receiving openings 20 in carrier 10 that holds more than two containers 5. Carrier 10 shown in FIG. 5 also requires bottom 35 because, of the twelve containers 5 in package 10, the lower six containers 5' in package 1 are not supported around chime 7 by retainer sheet 15. Therefore, bottom 35 provides support for those containers 5 not supported within container receiving openings 20.

As shown in FIGS. 3–5, package 1 may additionally contain pull tab 45 and/or line of perforation 47 positioned within film sleeve 30. Using an arrangement such as shown in FIGS. 3–5, package 1 may be opened by pulling pull tab 45 across longitudinal side 17 of package 1 thereby tearing line of perforation 47 to access containers 5.

A package according to FIGS. 4 and 5 will have the novel characteristic of having an upper level of containers 5 removable from a lower level of container 5' while keeping the upper level of containers 5 integrated as a sub-package and permitting the lower level of containers 5' to be freely removable for individual consumption or storage.

Figure 6:
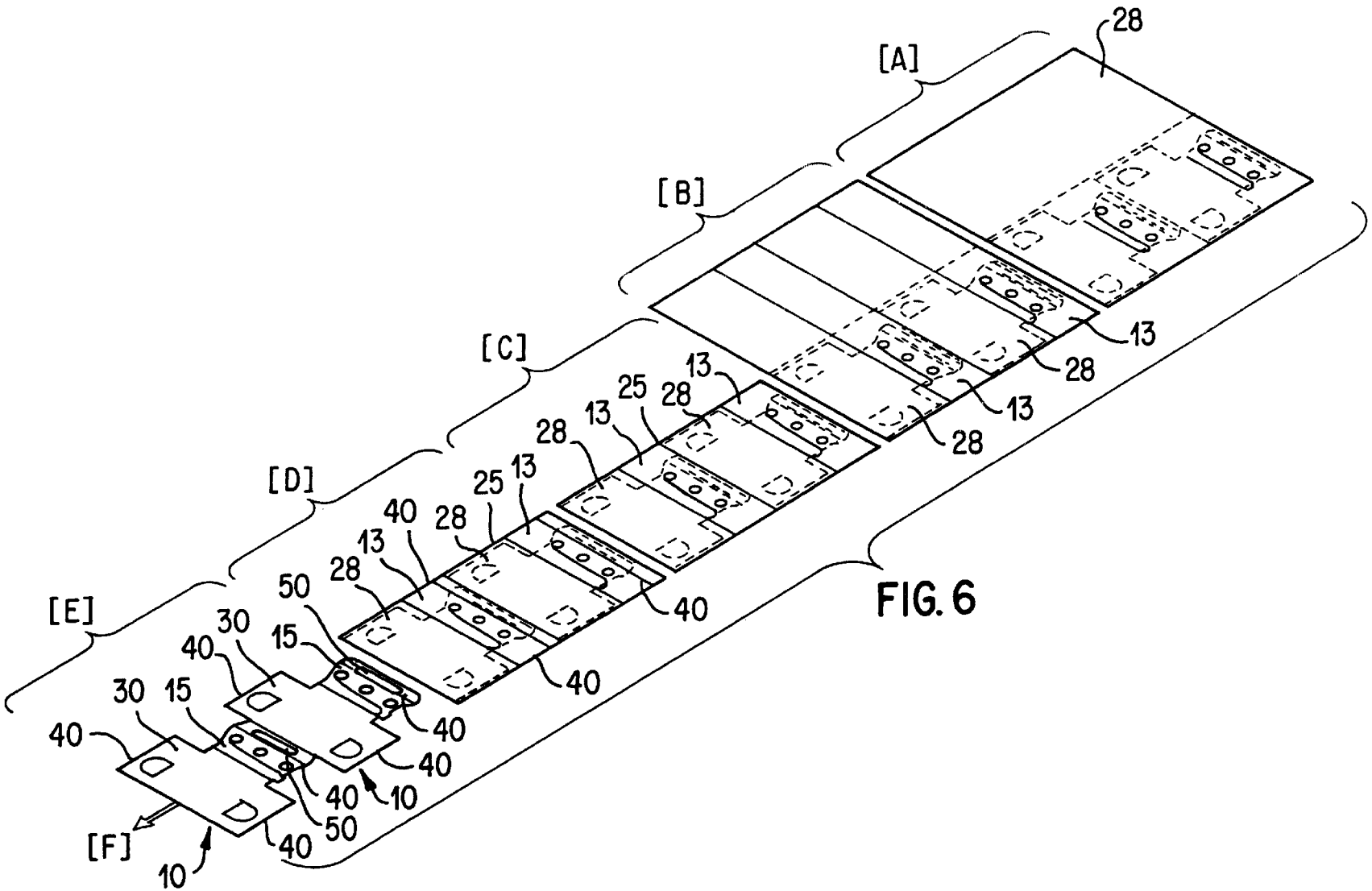
FIG. 6 is a schematic of a method for making a carrier for holding a plurality of containers according to one preferred embodiment of this invention.

According to one preferred embodiment of this invention, perforated removal strip 49 facilitates the efficient removal of the upper level of containers 5 and retainer sheet 15 from the lower level of containers 5 and sleeve 30. Perforated removal strip 49 is designed so a single pulling action of tab 45 circumferentially around package 1 will disassociate retainer sheet 15 and upper level of containers 5' from sleeve 30. Tabs 45 at an end panel of package 1 permit such single pulling action removal from either side of package 1. FIG. 6 shows carrier 10 according to this preferred embodiment, which is contemplated to be manufactured similar to FIG. 7, described below.

FIGS. 6–10 show methods for manufacturing carrier 10 according to three preferred methods of this invention. The methods shown in FIGS. 6–10 demonstrate from right to left the assembly of various components of carrier 10, each step in the method designated by a letter of the alphabet. Each step of each method of manufacture includes two carriers 10 to demonstrate a representative segment of carriers 10 that are typically formed in a generally continuous length.

FIG. 6 shows a method for manufacturing carrier 10 according to one preferred embodiment of this invention. In step [A] film substrate 28 is printed with desired graphics and other merchandising information. In step [B] retainer sheet material 13 is joined to film substrate 28 by glueing or otherwise attaching retainer sheet material 13 to film substrate 28. In step [C] retainer sheet material 13 and film substrate 28 are folded along fold line 25 to create a symmetrical double layer. In step [D] seams 40 are added by heat sealing or laminating the symmetrical double layer of retainer sheet material 13 and film substrate 28 together. In step [E] carrier 10 is formed by cutting, such as in a punch press, the double layer of retainer sheet material 13 and film substrate 28 to define film sleeve 30 and retainer sheet 15. Step [F] (not shown) preferably comprises accumulating the continuous strip of carriers 10 by fan folding or rolling about a core. Carriers 10 according to this invention, regardless of the method of manufacture, are not conducive to winding on reels because of the variable thickness between film sleeve 30 and retainer sheet 15.

Figure 7:
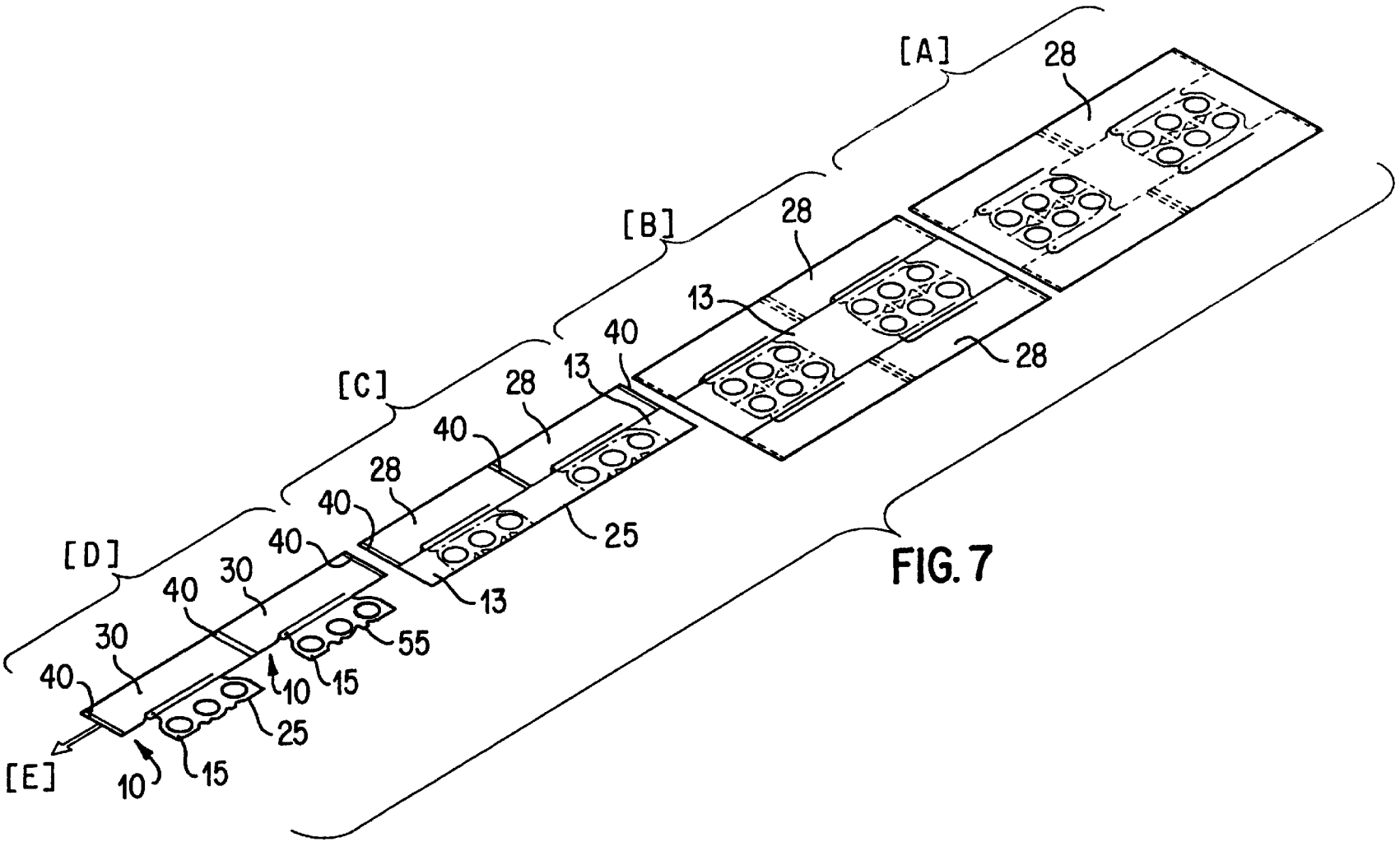
FIG. 7 is a schematic of a method for making a carrier, similar to the carriers shown in FIGS. 2 and 3, for holding a plurality of containers according to another preferred embodiment of this invention.

FIG. 7 shows a method for manufacturing carrier 10 according to another preferred embodiment of this invention. In step [A] film substrate 28 is printed with desired graphics and other merchandising information. In step [B] retainer sheet material 13 is joined to film substrate 28 by extrusion coating, laminating, profile extrusion, or glueing retainer sheet material 13 to film substrate 28. In step [C] retainer sheet material 13 and film substrate 28 are folded along fold line 25 to create a symmetrical double layer and seams 40 are added by heat sealing or laminating the symmetrical double layer of retainer sheet material 13 and film substrate 28 together. In step [D] carrier 10 is formed by cutting, such as in a punch press, the double layer of retainer sheet material 13 and film substrate 28 to define film sleeve 30 and retainer sheet 15. Step [E] (not shown) preferably comprises accumulating the continuous strip of carriers 10 by fan folding or rolling about a core.

Figure 8:
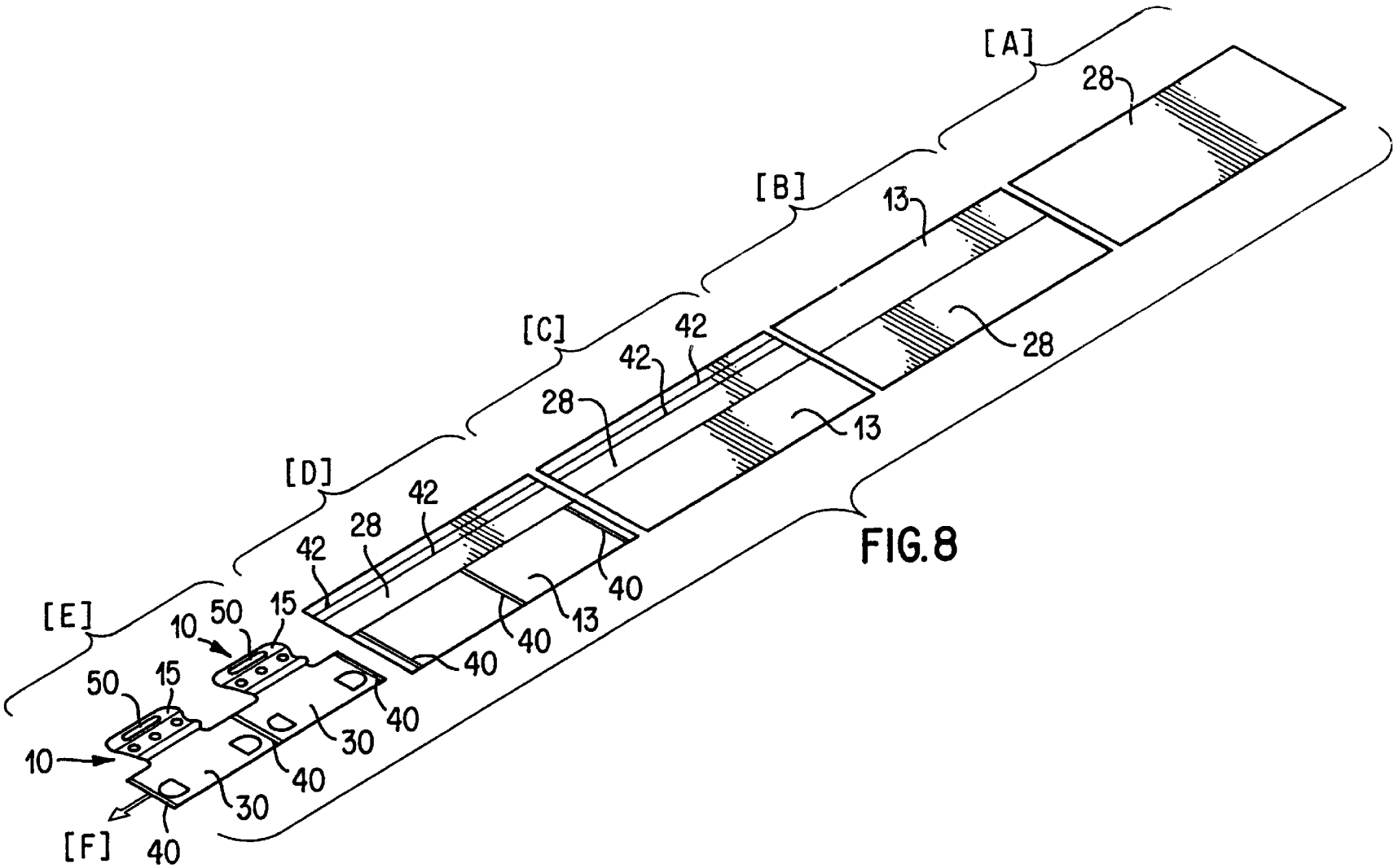
FIG. 8 is a schematic of a method for making a carrier for holding a plurality of containers according to yet another preferred embodiment of this invention.

FIG. 8 shows a method for manufacturing carrier 10 according to yet another preferred embodiment of this invention. In step [A] film substrate 28 is printed with desired graphics and other merchandising information. In step [B] retainer sheet material 13 is joined to film substrate 28 by extrusion coating or laminating retainer sheet material 13 to film substrate 28. In step [C] two identical sheets of retainer sheet material 13 and film substrate 28 are laminated together along lamination lines 42. Step [C] requires careful registration to align two identical portions of joined retainer sheet material 13 and film substrate 28 prior to lamination. In step [D] seams 40 are added by heat sealing or laminating the two identical sheets of retainer sheet material 13 and film substrate 28 together. In step [E] carrier 10 is formed by cutting, such as in a punch press, the two sheets of retainer sheet material 13 and film substrate 28 to define film sleeve 30 and retainer sheet 15. Step [F] (not shown) preferably comprises accumulating the continuous strip of carriers 10 by fan folding or rolling about a core.

Figure 9:
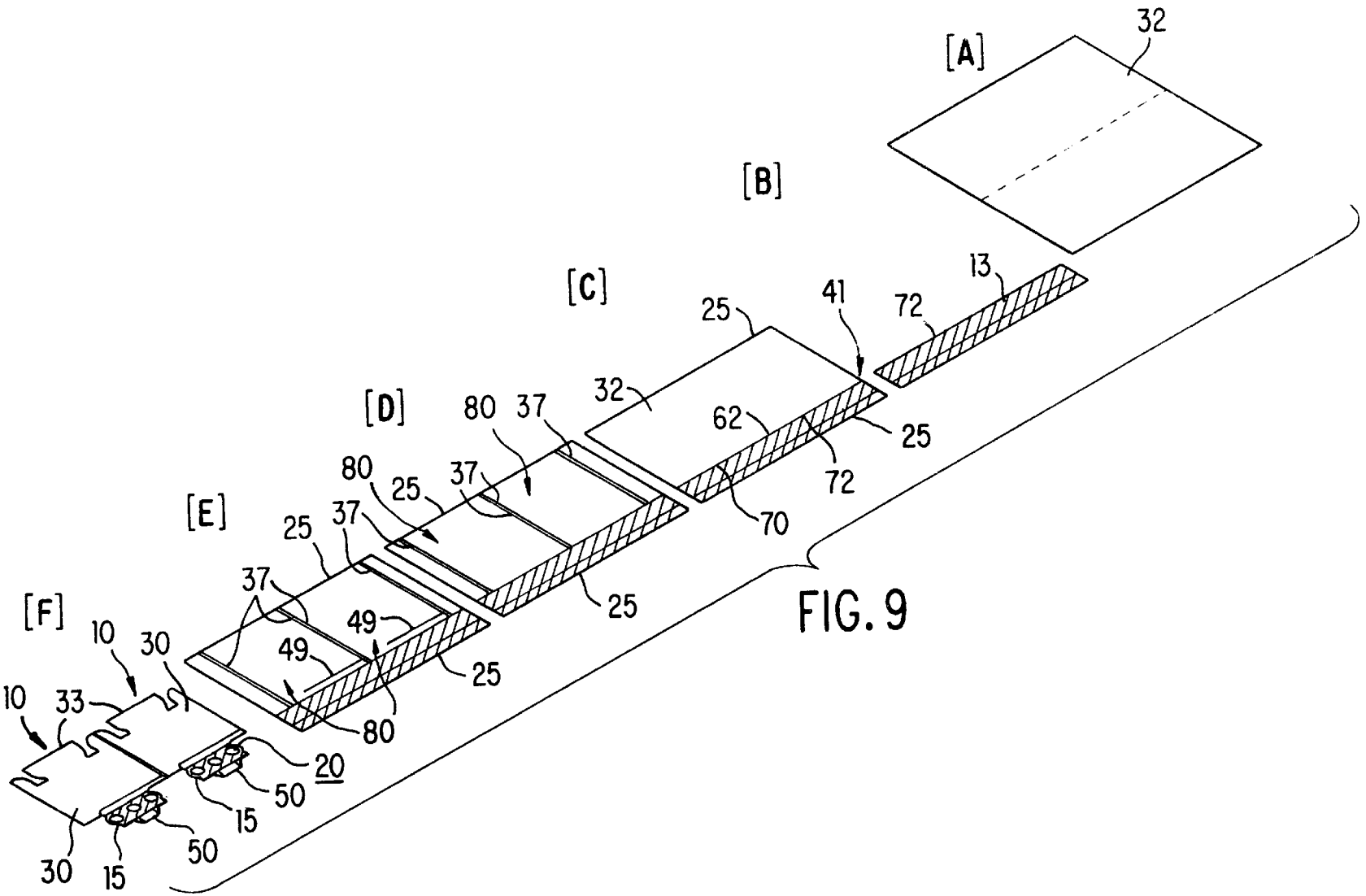
FIG. 9 is a schematic of a method for making a carrier for holding a plurality of containers according to yet another preferred embodiment of this invention.

Another method for manufacturing carrier 10 for carrying a plurality of containers is shown in FIG. 9. As shown in step [A], film sleeve material 32 is preprinted with appropriate graphics and/or product information. Step [B] shows retainer sheet material 13 provided for incorporation with film sleeve material 32. Retainer sheet material 13 is either folded and/or comprises a pair of sheets laid on top of each other and then may be laminated and/or sealed prior to incorporation with film sleeve material 32. Step [C] shows retainer sheet material 13 folded over and connected with respect to film sleeve material 32, such as with a heat seal 41, preferably near a periphery of two opposed edges 60 of retainer sheet material 32. As a result of the above-described steps, retainer sheet material 13 and film sleeve material 32 may be manufactured, printed and shipped separately, i.e. on separate rolls or coils, prior to completion of final carrier 10.

As further shown in steps [C] and [D] of FIG. 9, retainer sheet material 13 is further attached with respect to film sleeve material 32 along a pair of opposed edges 60 along an open end 62 of the folded retainer sheet material 13 and a pair of opposed edges 70 along an open end 72 of the folded film sleeve material 32 to form carrier blank 80. According to a preferred embodiment of this invention, carrier 10 is preferably symmetrically formed about at least one fold line 25. Pair of opposed edges 60 of retainer sheet material 13 may be sealed, joined, bonded, adhered or any other attachment method known to those having ordinary skill in the art, to pair of opposed edges 70 of film sleeve material. Step [D] additionally shows the attachment of side edges 37 with respect to each other with welds and/or heat seals.

In steps [E] and [F], additional features of carrier 10 are formed including perforations defining removal strip 49 and the plurality of container receiving openings 20 to complete carrier 10. Step [F] also may require cutting lower fold line 25 so as to create open end 33 in carrier 10. As a result, carrier 10 includes an open end 33 sufficiently large to allow film sleeve 30 to be slid over at least a pair of containers 5.

Figure 10:
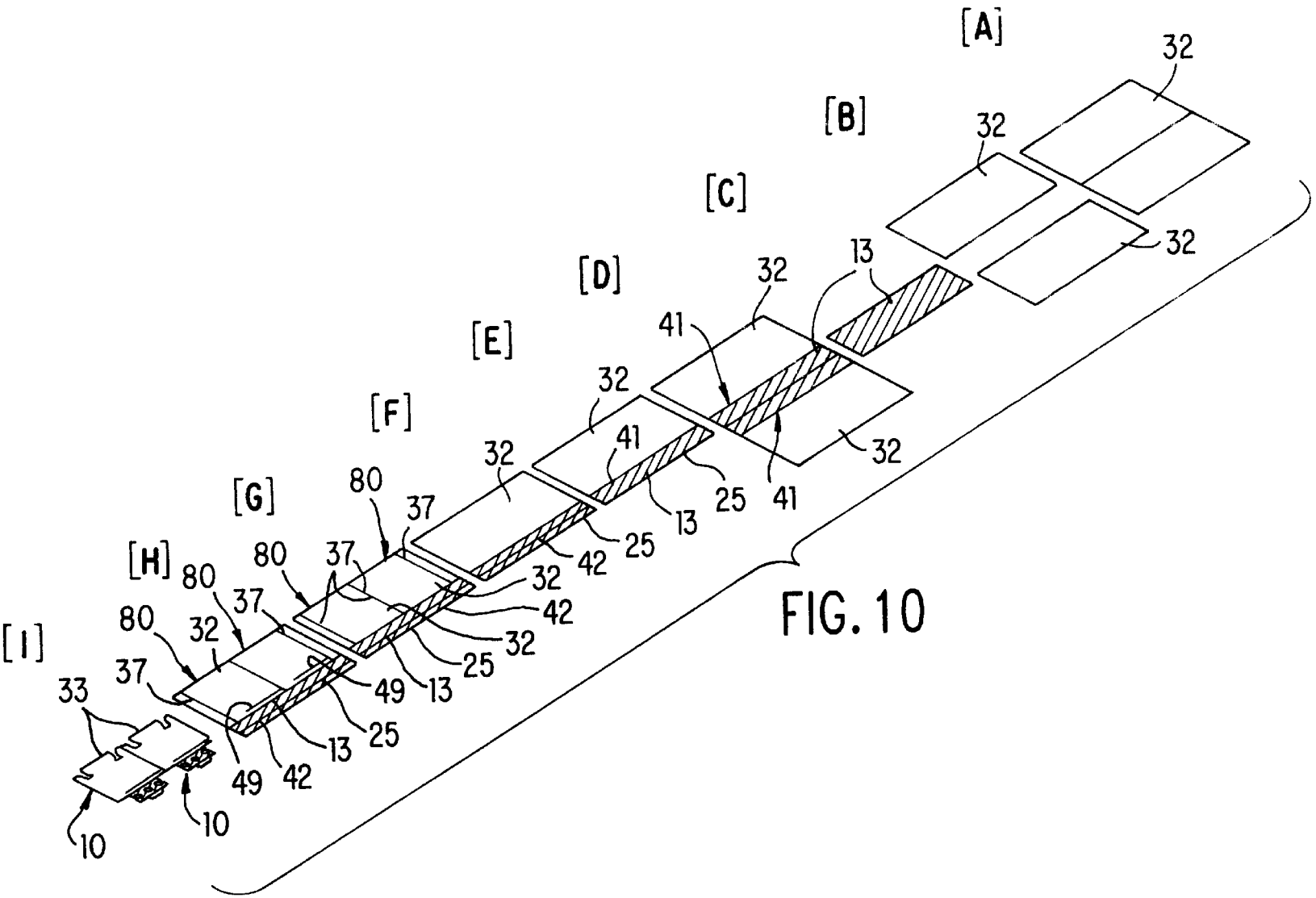
FIG. 10 is a schematic of a method for making a carrier for holding a plurality of containers according to yet another preferred embodiment of this invention.

Another method for manufacturing carrier 10 for carrying a plurality of containers is shown in FIG. 10. As shown in step [A] film sleeve material 32 is preprinted with appropriate graphics and/or product information. Step [B] shows film sleeve material 32 cut into two discrete sections. Alternatively, this method may start with step [B] wherein two separate sheets and/or coils of film sleeve material 32 are provided for incorporation into carrier 10. Step [C] shows retainer sheet material 13 provided for incorporation with film sleeve material 32. Retainer sheet material 13 is either folded and/or comprises a pair of sheets laid on top of each other and then may be laminated and/or sealed prior to incorporation with film sleeve material 32. Step [D] shows retainer sheet material 13 connected with respect to the two discrete sections of film sleeve material 32 along two sides of retainer sheet material 13, such as with seals 41, thereby forming one or more carrier blanks 80. Like the method shown in FIG. 9, this method permits retainer sheet material 13 and film sleeve material 32 to be manufactured, printed and shipped separately, i.e. on separate rolls, prior to completion of final carrier 10.

As further shown in step [E] of FIG. 10, according to a preferred embodiment of this invention, carrier blank 80 is preferably symmetrically formed about at least one fold line 25 or comprises two or more sheets welded and/or laminated with respect to each other. Step [F] additionally shows the placement of laminations or longitudinal seals 42 to create a spine for retainer sheet 15. Steps [G], [H] and [I] further show the attachment of sealed side edges 37 with respect to each other with welds and/or heat seals as well as additional features of carrier 10 including perforations defining removal strip 49 and the plurality of container receiving openings 20 to complete carrier 10. As shown in step [H], tear or removal strip 49 is positioned below seal 41. According to one preferred embodiment of this invention, handle 50 is also formed in carrier 10.

As described in the various embodiments of this invention, retainer sheet material 13 and/or retainer sheet 15 may have a first thickness and film sleeve material 32 and/or film sleeve 30 may have a second thickness thinner than the first thickness. Alternatively, the first thickness and the second thickness may be the same. Finally, regardless of the relative thicknesses, retainer sheet material 13 and film sleeve material 32 may have different rigidities and/or elasticities.

Also as described in the various embodiments of this invention, retainer sheet material 13, retainer sheet 15, film sleeve material 32 and/or film sleeve 30 may be shipped on a single coil of material, on separate coils between retainer sheet material 13 and film sleeve material 32 or each on multiple coils for incorporation into carrier 10.

While in the foregoing specification this invention has been described in relation to certain preferred embodiments thereof, and many details have been set forth for purpose of illustration, it will be apparent to those skilled in the art that carrier 10 is susceptible to additional embodiments and that certain of the details described herein can be varied considerably without departing from the basic principles of the invention.

I claim:

1. A method for manufacturing a carrier for carrying a plurality of containers, the method comprising:

attaching a retainer sheet material to a film sleeve material between a length of the retainer sheet material and a length of the film sleeve material to form a carrier blank;

forming a plurality of container receiving openings in the retainer sheet material;

creating an opening in the film sleeve material sufficiently large to allow the film sleeve to be slid over the plurality of containers so that the plurality of containers are wrapped in the film sleeve material; and inserting a container of the at least a pair of containers into the opening of the film sleeve and into a corresponding container receiving opening of the plurality of container receiving openings.

2. The method of claim 1 further comprising symmetrically forming the carrier about at least one fold line.

3. The method of claim 1 wherein the retainer sheet material has a first thickness and the film sleeve material has a second thickness thinner than the first thickness.

4. A method for manufacturing a single-piece carrier for carrying a plurality of containers, the method comprising:

forming a retainer sheet portion of the carrier having a first thickness;

forming a film sleeve portion of the carrier having a second thickness, the second thickness thinner than the first thickness;

sealing the film sleeve portion to the retainer sheet portion longitudinally between the film sleeve portion and the retainer sheet portion;

forming a plurality of container receiving openings in the retainer sheet portion;

wrapping the plurality of containers within the film sleeve portion; and inserting a container of the plurality of containers into each opening of the plurality of container receiving openings.

5. The method of claim 4 further comprising:

forming the film sleeve portion in two discrete sections;

sealing the two discrete sections with respect to two sides of the retainer sheet portion.

6. The method of claim 4 further comprising forming a handle in the retainer sheet portion.

7. The method of claim 4 further comprising symmetrically forming the carrier about a fold line.

8. A method for manufacturing a single-piece carrier for carrying a plurality of containers, the method comprising:

forming a retainer sheet portion of the carrier having a first thickness;

forming a film sleeve portion of the carrier having a second thickness, the second thickness different than the first thickness;

sealing the film sleeve portion to the retained sheet portion near a periphery of two opposed edges of the retainer sheet along a seal extending longitudinally between the film sleeve portion and the retained sheet portion;

forming a plurality of container receiving openings in the retainer sheet portion and an opening in the film sleeve portion; and inserting the plurality of containers into the opening in the film sleeve portion and the retainer sheet portion of the single-piece carrier so that the film sleeve portion substantially covers the plurality of containers and so that the plurality of container receiving openings are each stretched over a container of the plurality of containers.

9. The method of claim 8 further comprising:

folding the film sleeve portion to form an open end;

folding the retainer sheet portion to form an open end;

attaching the film sleeve portion with respect to the retainer sheet portion along each respective open end.

10. The method of claim 8 further comprising:

forming the film sleeve portion in two discrete sections;

sealing the two discrete sections with respect to two sides of the retainer sheet portion.

* * * * *